US009797139B2

(12) United States Patent
Savard

(10) Patent No.: US 9,797,139 B2
(45) Date of Patent: Oct. 24, 2017

(54) CONCRETE SLAB ATTACHMENT DEVICE AND METHOD

(71) Applicant: Normand Savard, Baie-Comeau (CA)

(72) Inventor: Normand Savard, Baie-Comeau (CA)

( * ) Notice: Subject to any disclaimer, the term of this patent is extended or adjusted under 35 U.S.C. 154(b) by 0 days.

(21) Appl. No.: 15/060,108

(22) Filed: Mar. 3, 2016

(65) Prior Publication Data

US 2016/0258163 A1 Sep. 8, 2016

Related U.S. Application Data

(60) Provisional application No. 62/127,888, filed on Mar. 4, 2015.

(51) Int. Cl.

| | |
|---|---|
| ***E04C 5/16*** | (2006.01) |
| ***E04C 2/04*** | (2006.01) |
| ***E04C 2/38*** | (2006.01) |
| ***E04C 5/01*** | (2006.01) |

(52) U.S. Cl.

CPC ..... *E04C 5/162* (2013.01); *E04C 2/044* (2013.01); *E04C 2/38* (2013.01); *E04C 5/01* (2013.01)

(58) Field of Classification Search

CPC ... E04C 2/044; E04C 2/38; E04C 5/01; E04C 5/162

USPC ..... 52/414, 576, 578, 582.1, 583.1, 586.1, 52/585.1, 596, 393, 396.04, 396.05, 745.2

See application file for complete search history.

(56) References Cited

U.S. PATENT DOCUMENTS

| | | | | | |
|---|---|---|---|---|---|
| 3,230,683 | A * | 1/1966 | Foster | E04B 1/043 | 52/127.12 |
| 3,600,863 | A * | 8/1971 | Nachtsheim | E04B 5/10 | 52/483.1 |
| 3,842,562 | A * | 10/1974 | Daigle | E01C 5/08 | 404/50 |
| 3,993,341 | A * | 11/1976 | Bentley | E04B 1/215 | 294/89 |
| 4,021,984 | A * | 5/1977 | Honegger | B28B 23/00 | 249/194 |
| 4,030,262 | A * | 6/1977 | Dean | E04C 2/044 | 52/285.1 |
| 4,781,006 | A * | 11/1988 | Haynes | E04B 1/215 | 52/583.1 |
| 5,134,828 | A * | 8/1992 | Baur | E04B 1/043 | 52/699 |

(Continued)

*Primary Examiner* — Brent W Herring
(74) *Attorney, Agent, or Firm* — Gonzalo Lavin

(57) ABSTRACT

An attachment device attaches adjacent first and second concrete pieces to one another along corresponding first and second interfacing side surfaces thereof, thereby forming a concrete piece attachment arrangement. The device includes an elongate base member having opposed first and second portions, and first and second lateral members securing to and respectively extending substantially perpendicularly from first and second ends of the base member. The first and second portions of the base member extend within first and second recesses respectively formed into the concrete pieces, in a direction generally perpendicular to the first and second interfacing side surfaces. The first and second lateral member respectively extend through bore holes extending through the first and second concrete pieces and connecting with the respective first and second recesses. A method for attaching the concrete pieces to one another with an attachment piece is also described.

5 Claims, 3 Drawing Sheets

(56) References Cited

U.S. PATENT DOCUMENTS

| | | | | |
|---|---|---|---|---|
| 5,586,834 | A * | 12/1996 | Tsuji | E01C 11/14 404/60 |
| 6,354,053 | B1 * | 3/2002 | Kerrels | E01C 5/08 404/47 |
| 6,568,139 | B2 * | 5/2003 | Bot | E01D 19/125 52/125.5 |
| 7,975,444 | B2 * | 7/2011 | Holdsworth | E04B 1/043 403/296 |
| 8,302,359 | B2 * | 11/2012 | Boxall | E01C 11/14 404/57 |
| 8,479,471 | B2 * | 7/2013 | Liberman | E04B 1/21 52/741.1 |
| 8,756,898 | B1 * | 6/2014 | Backhaus | E04B 5/023 404/47 |
| 8,844,242 | B2 * | 9/2014 | Liberman | E04B 1/21 52/583.1 |
| 9,410,316 | B2 * | 8/2016 | Reigstad | E04B 5/32 |
| 2001/0039773 | A1 * | 11/2001 | Bot | E01D 19/125 52/259 |
| 2006/0075706 | A1 * | 4/2006 | Boxall | E01C 11/14 52/414 |
| 2014/0020321 | A1 * | 1/2014 | Eklund | E04B 1/043 52/582.1 |
| 2015/0040496 | A1 * | 2/2015 | Holzberger | F16B 5/0024 52/223.13 |

* cited by examiner

CONCRETE SLAB ATTACHMENT DEVICE AND METHOD

CROSS REFERENCE TO RELATED APPLICATION

Benefit of U.S. Provisional Application for Patent Ser. No. 62/127,888 filed on Mar. 4, 2015, being incorporated herein by reference, is hereby claimed.

FIELD OF THE INVENTION

The present invention relates to attachment devices, and more specifically to an attachment device for securing concrete slabs to one another, along with the arrangement thereof and method therefore.

BACKGROUND OF THE INVENTION

It is well known in the art of concrete to attach two pieces of concrete to one another using metallic bars crossing over both pieces and secured thereto via screws or the like into pre-drilled holes or inserts. This type of attachment always remains visible and exposed to the environment, thereby being subjected to corrosion or even providing access for water and/or contaminants to get into the concrete and locally weaken the integrity of the concrete piece. Accordingly, in order to avoid these problems, manufacturers either pour concrete on-site or manufacture and transport the appropriate large pieces of concrete, which is quite expensive such that another problem is raised by solving a first one.

Accordingly, there is a need for improved attachment device for securing concrete slabs to one another, arrangement thereof and method therefore.

SUMMARY OF THE INVENTION

It is therefore a general object of the present invention to provide improved attachment device for securing concrete slabs to one another, arrangement thereof and method therefore, that solve the above-mentioned problems and drawbacks.

An advantage of the present invention is that the attachment device and method ensure that all non-concrete (i.e. metallic or composite or both, for example) components remains fully embedded into the concrete, such that the attachment interface is substantially invisible after the connection of the two concrete pieces (such as concrete slabs or the like).

Another advantage of the present invention is that the attachment device and method provide for a significant surface area of each concrete piece to be adhered to by concrete being poured there between so as to ensure a strong interface.

Yet another advantage of the present invention is that the attachment device and method ensure provide for a relatively simple and strong attachment of two adjacent pieces of concrete to be connected to one another so as to form a larger piece with no weakness at the interface.

A further advantage of the present invention is that the attachment device and method ensure that all air entrapped between the two pieces of concrete can easily escape when the cementing concrete is being poured there between.

Still another advantage of the present invention is that the attachment device and method ensure that the attachment device engages and is secured to one of the two pieces prior to engagement with the second piece.

Yet another advantage of the present invention is that the attachment device and method allow for a plurality of attachment devices to be used and spaced apart from one another along the interfacing walls of the two concrete pieces.

A further advantage of the present invention is that the attachment device and method allow for reinforcing bars to be pre-embedded into each concrete piece around each attachment location to prevent possible local weakness there around.

According to an aspect of the present invention there is provided an attachment device for attaching adjacent first and second concrete pieces to one another along corresponding first and second interfacing side surfaces thereof, said attachment device comprising:

- an elongate base member having opposed first and second portions opposed to one another, the first and second portions being adapted to extend within first and second recesses respectively formed into both adjacent first and second concrete pieces, in a direction generally perpendicular to the first and second interfacing side surfaces;
- a first lateral member securing to and extending substantially perpendicularly from a first end of the elongate base member, the first lateral member being adapted to extend through a bore hole extending through the first concrete piece and connecting with the first recess; and
- a second lateral member securing to and extending substantially perpendicularly from a second end of the elongate base member, the second lateral member being adapted to extend through a bore hole extending through the second concrete piece and connecting with the second recess.

Conveniently, at least one said elongate base member and said first and second lateral members, and preferably the elongate base member, is adapted for attaching to one of the first and second concrete pieces.

Typically, the elongate base member includes an attachment tab extending substantially perpendicularly therefrom and adapted for attaching to one of the first and second concrete pieces adjacent a corresponding one said interfacing side surfaces.

In one embodiment, the attachment device includes a top transverse member extending from adjacent a free end of said first lateral member to adjacent a free end of said second lateral member and connecting to at least one said first and second lateral members.

Conveniently, the top transverse member is secured to at least one said first and second lateral members.

According to another aspect of the present invention there is provided a method for attaching two adjacent first and second concrete pieces to one another along corresponding first and second interfacing side surfaces thereof with an attachment device connecting to both the first and second concrete pieces, said first and second concrete pieces having first and second recesses formed therein respectively, said first and second concrete pieces having first and second bore holes respectively extending there through adjacent the corresponding interfacing side surface and connecting with the first and second recesses respectively, said attachment device having an elongate base member and first and second lateral members extending respectively at first and second ends thereof and substantially perpendicularly therefrom, said method comprising the steps of:

placing the first and second interfacing side surfaces in general abutment contact with each other, with the first and second recesses in alignment with one another;

positioning the attachment device across the first and second concrete pieces with the elongate base member extending into the first and second recesses and with the first and second lateral members extending through said first and second bore holes of said first and second concrete pieces, respectively; and filling at least said first and second bore holes of the first and second concrete pieces around the first and second lateral members, and an interstice between the first and second interfacing side surfaces with concrete.

Conveniently, the step of filling with concrete further includes filling the first and second recesses with concrete.

In one embodiment, the first and second recesses are first and second bottom recesses and extend into the first and second concrete pieces from corresponding bottom surfaces thereof, the first and second concrete pieces further including first and second top recesses respectively extending therein from corresponding top surfaces thereof, the first and second top recesses being substantially parallel to the corresponding first and second bottom recesses and connecting with a corresponding said first and second bore holes, wherein the steps of positioning and filling further includes:

positioning a top transverse member of the attachment device across the first and second concrete pieces to extend into the first and second top recesses and to connect with at least one said first and second lateral members; and filling the first and second bottom recesses and the first and second top recesses with concrete.

In one embodiment, at least one said first and second concrete pieces includes a side recess extending therein from a corresponding said first and second interfacing side surfaces, the side recess communicating with corresponding said first and second bottom recesses and corresponding said first and second top recesses, wherein the step of filling further includes filling the side recess with concrete.

Conveniently, the side recess is substantially centrally located relative to the corresponding said first and second interfacing side surfaces.

In one embodiment, at least a top outer edge of at least one said interfacing side surfaces is chamfered, wherein the step of filling further includes filling at least a top edge chamfered recess of at least one of said interfacing side surfaces with concrete.

In one embodiment, the elongate base member includes an attachment tab extending substantially perpendicularly therefrom, wherein the step of positioning further includes attaching/securing the attachment tab to one of the first and second concrete pieces adjacent a corresponding one said interfacing side surfaces.

According to a further aspect of the present invention there is provided a concrete piece attachment arrangement comprising:

first and second concrete pieces positioned adjacent one another along corresponding first and second interfacing side surfaces thereof, the first and second concrete pieces having first and second recesses respectively formed therein and extending inwardly from a respective one of the first and second interfacing side surfaces, the first and second concrete pieces having first and second bore holes extending therethrough, respectively, and connecting with the first and second recesses, respectively; and an attachment device for attaching the first and second concrete pieces to one another along the corresponding first and second interfacing side surfaces, said attachment device including:

an elongate base member having opposed first and second portions opposed to one another, the first and second portions extending within the first and second recesses respectively, in a direction generally perpendicular to the first and second interfacing side surfaces;

a first lateral member securing to and extending substantially perpendicularly from a first end of the elongate base member, the first lateral member extending through the first bore hole; and a second lateral member securing to and extending substantially perpendicularly from a second end of the elongate base member, the second lateral member extend through the second bore hole.

Conveniently, at least one said elongate base member and said first and second lateral members is adapted for attaching to one of the first and second concrete pieces.

Typically, the elongate base member includes an attachment tab extending substantially perpendicularly therefrom and attaching to one of the first and second concrete pieces adjacent a corresponding one said interfacing side surfaces.

In one embodiment, the attachment device includes a top transverse member extending from adjacent a free end of said first lateral member to adjacent a free end of said second lateral member and connecting to at least one said first and second lateral members.

Conveniently, the top transverse member is secured to at least one said first and second lateral members.

In one embodiment, the first concrete piece includes a reinforcing rod embedded therein and extending at least between the first bore hole and the first interfacing side surface.

In one embodiment, for each one of the first and second bore holes, a reinforcing rod is embedded in the corresponding one of the first and second concrete pieces and extends at least between the corresponding one of the first and second bore holes and the corresponding one of the first and second interfacing side surfaces.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiment of the present invention will be herein described for indicative purpose and by no means as of limitation.

Figure 1:
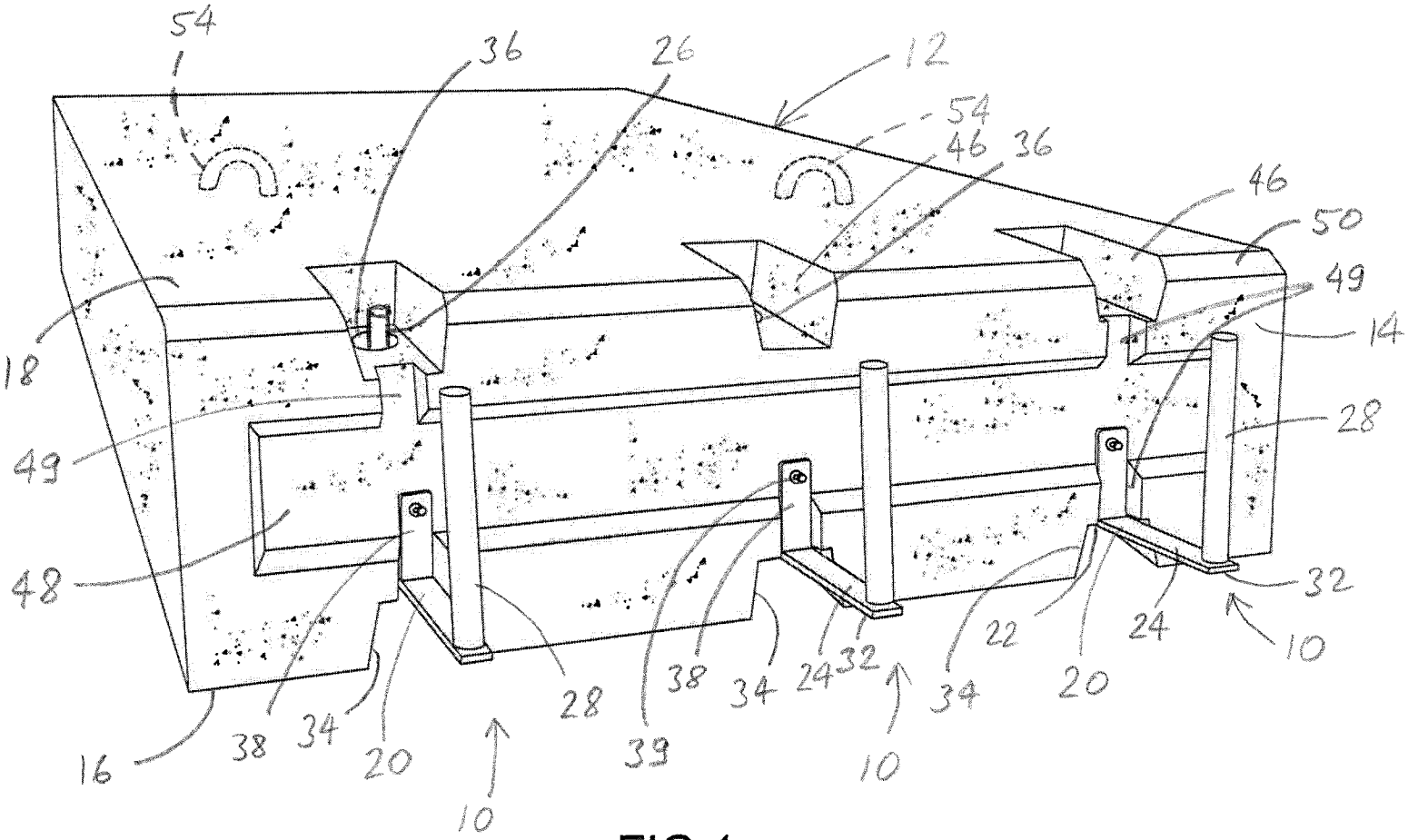
FIG. 1 is a simplified perspective view of concrete slab attachment devices in accordance with an embodiment of the present invention attached to a first concrete slab.
Figure 2:
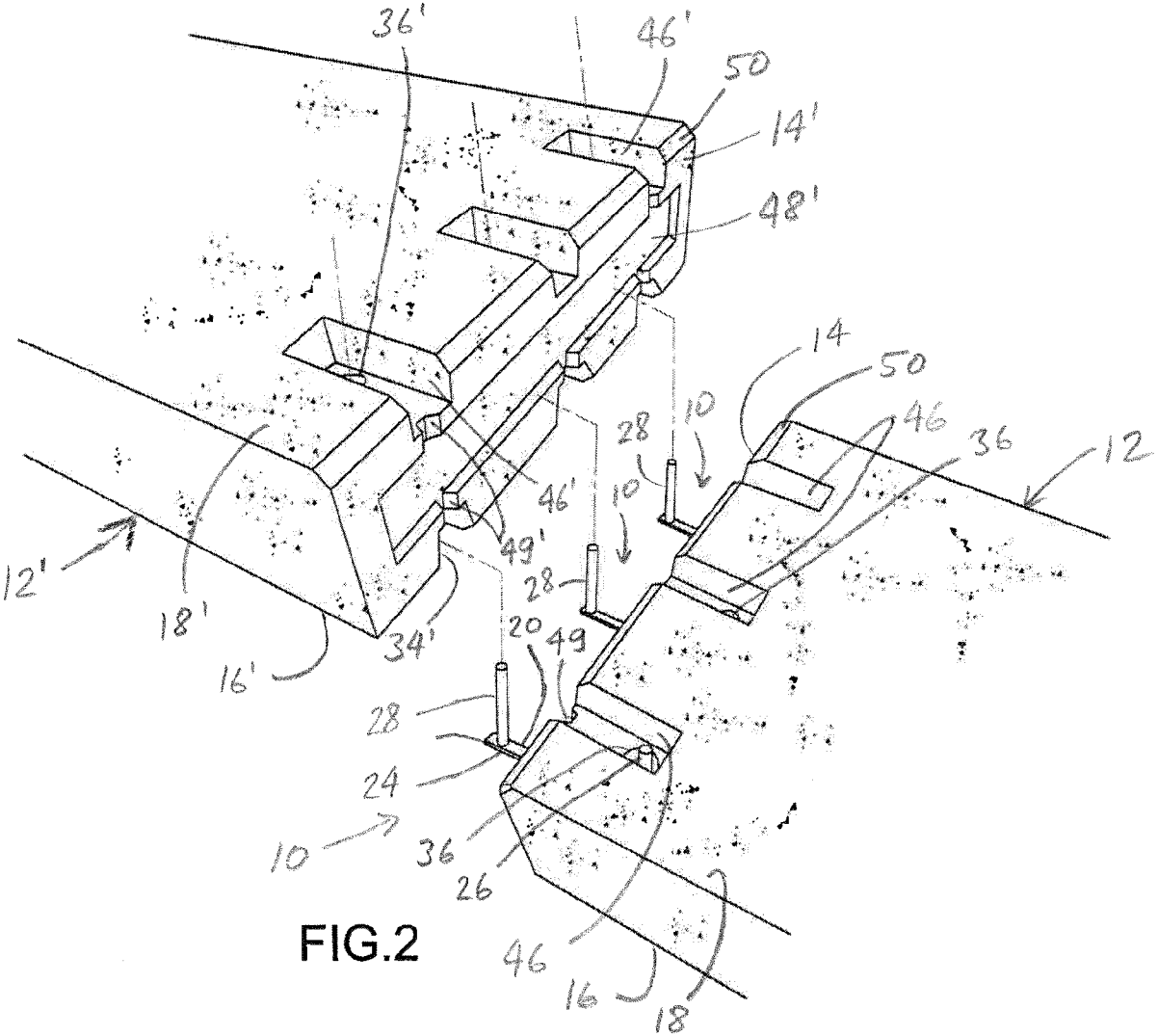
FIG. 2 is an exploded partially broken perspective view of the attachment devices of FIG. 1 being engaged with a second concrete slab.
Figure 3:
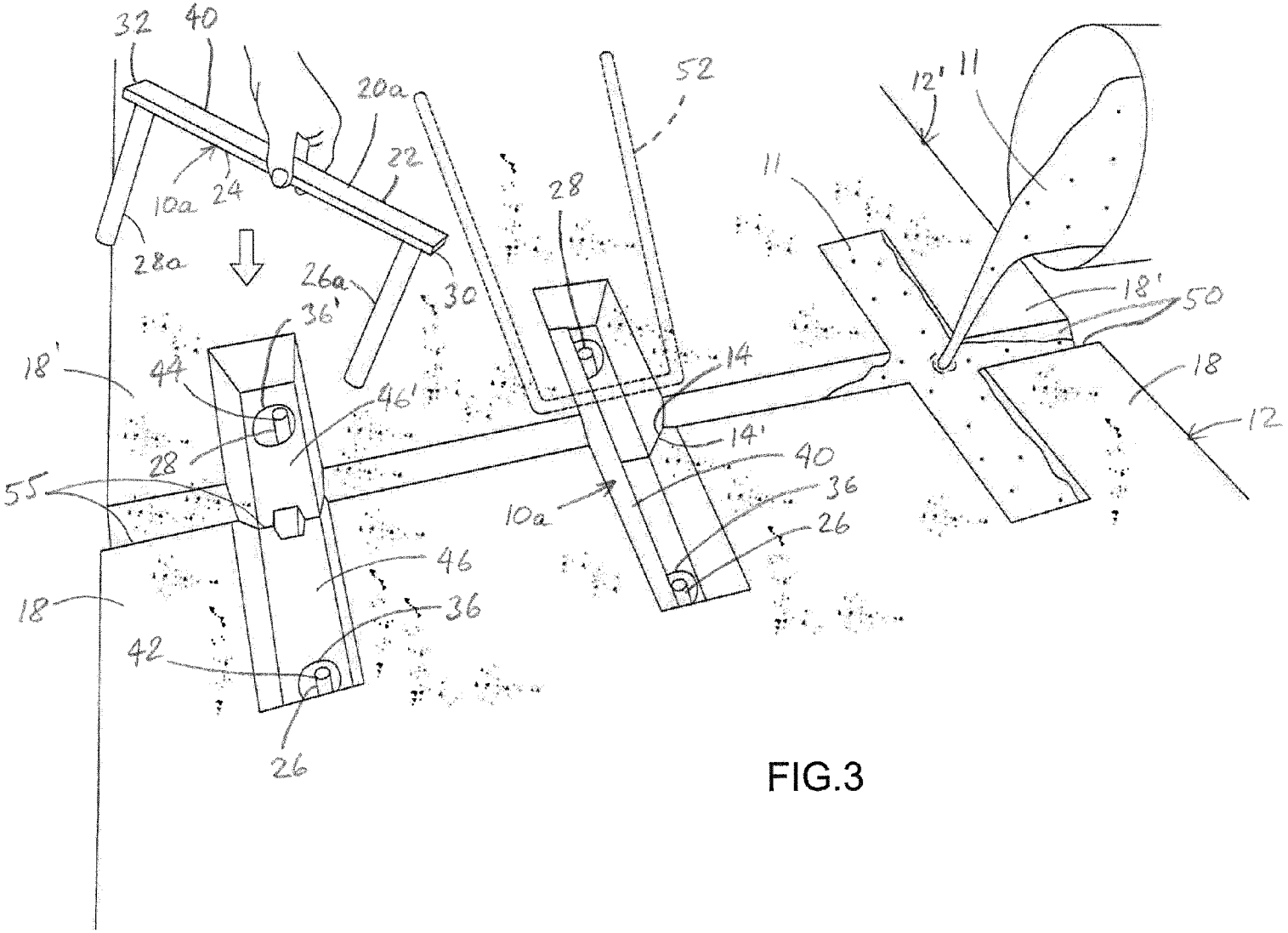
FIG. 3 is a partially broken perspective view of the attachment devices of FIG. 1 being engaged to the first and second concrete slabs, showing concrete being poured into different recesses.

Referring to FIGS. 1, 2 and 3, there is shown three concrete piece attachment devices 10 in accordance with an embodiment of the present invention, for attaching adjacent first 12 and second 12' concrete pieces (typically slabs) to one another along corresponding first 14 and second 14' interfacing side surfaces thereof, so as to form a single slab. Although three attachment devices 10 are shown, it would be obvious to one skilled in the art that any number of attachment devices 10 can be used to secure two pieces to one another, depending on the size of the two pieces 12, 12', thus forming a concrete piece attachment arrangement all together.

Each attachment device 10 includes an elongate base member 20 having opposed first 22 and second 24 portions opposed to one another, a first lateral member 26 securing to and extending substantially perpendicularly from a first end 30 of the elongate base member 20, and a second lateral member 28 securing to and extending substantially perpendicularly from a second end 32 of the elongate base member 20. The first 22 and second 24 portions are adapted to extend within first 34 and second 34' bottom recesses respectively formed into both adjacent first 12 and second 12' concrete pieces, in a direction generally perpendicular to the first 14 and second 14' interfacing side surfaces and in connection there with. The first and second bottom recesses 34, 34' also extend from the corresponding bottom surface 16, 16'.

The first 26 and second 28 lateral members are adapted to extend through respective first 36 and second 36' bore holes that respectively extend through the first 12 and second 12' concrete pieces, between bottom 16, 16' and top 18, 18' surfaces thereof, substantially parallel to and in a spaced relationship relative to the respective interfacing side surface 14, 14', and respectively connect with the first 34 and second 34' bottom recesses.

The elongate base member 20 typically includes an attachment tab 38 that extend substantially perpendicularly therefrom for attaching to one of the first 12 and second 12' concrete pieces adjacent the corresponding interfacing side surface 14, 14'. The attachment tab 38 is typically secured to the concrete slab 12 or 12' via a concrete screw 39 or the like for holding the attachment device 10 in place relative to the concrete slab 12 or 12', with no portion of the attachment device 10 protruding out from the bottom 16, 16' and top 18, 18' surfaces of the two concrete slabs 12, 12', such that the attachment device 10 gets entirely immerged into the concrete 11 being poured (see FIG. 3) into the different recesses 34, 34' and bore holes 36, 36' around the interfacing side surfaces 14, 14' as further detailed hereinafter.

Preferably, the attachment device 10 further includes a top transverse member 40 that extends from a free end 42 of the first lateral member 26 to a free end 44 of the second lateral member 28, and connecting to at least one the two lateral members 26, 28. The top transverse member 40 can eventually secured to at least one of the two lateral members 26, 28, via a screw, welding or the like. In the embodiment shown, the top transverse member 40 is simply a base member 20*a* of another attachment device 10*a* positioned up-side-down relative to the attachment device 10 with its lateral members 26*a*, 28*a* inserted into the two bore holes 36, 36' adjacent the respective lateral members 26, 28 of the attachment device 10, as shown in FIG. 3.

The top transverse member 40 is typically adapted to extend within first 46 and second 46' top recesses respectively formed into both adjacent first 12 and second 12' concrete pieces, in a direction generally perpendicular to the first 14 and second 14' interfacing side surfaces and in connection there with, and in connection with respective bore hole 36, 36'. The top recesses 46, 46' are typically in parallel relationship and in alignment with the corresponding bottom recesses 34, 34', and extend from the corresponding top surface 18, 18'.

Each interfacing side surface 14, 14' of the concrete slabs 12, 12' typically includes a corresponding side recess 48, 48' extending into the slab 12, 12' therefrom. The side recess 48, 48', preferably substantially centrally located relative to the interfacing side surface 14, 14', communicates with the corresponding bottom 34, 34' and top 46, 46' recesses via channels 49, 49' to ensure flowing path for the concrete 11 that is poured between the two interfacing side surfaces 14, 14' to secure the two slabs 12, 12' to one another, and for the air to escape the space being filled with concrete to avoid air entrapment there between.

Since all the recesses 34, 34' 46, 46' 48, 48' are typically formed into the corresponding slab 12, 12', all corresponding side walls are usually angled relative to the corresponding bottom 16, 16', top 18, 18' and side 14, 14' surfaces instead of being perpendicular thereto. Similarly, all outer edges, and at least the top outer edge 50 (as shown in the Figures), of the interfacing side surface 14, 14' are preferably angled or chamfered. This improves the adhesion of the concrete 11 that is poured into all the recesses 34, 34' 46, 46' 48, 48', and therefore the attachment of the two slabs 12, 12' to one another, as well as the finishing of the visible interface.

As seen in FIG. 3, each slab 12, 12' typically includes at least one reinforcing rod 52 or the like (illustrated in stippled lines only around the central bore hole 36 for better clarity of the Figure) embedded therein and extending around each bore hole 36, 36', and typically at least between the bore hole 36, 36' and the corresponding interfacing side surface 14, 14'.

In order to ease transportation or displacement of the slabs 12, 12', as for their positioning relative to one another for attachment, each slab typically includes anchors 54 or the like (shown in stippled lines in FIG. 1). Obviously, although not illustrated herein, each anchor 54 could be located into a respective anchor recess and not protrude out from the top surface 18, 18', such that the anchor recess could be filled with concrete after final positioning of the slab 12, 12' to definitively hide the anchor 54.

The present invention also refers to a method for attaching two adjacent first 12 and second 12' concrete pieces to one another along corresponding first 14 and second 14' interfacing side surfaces thereof with an attachment device 10 connecting to both the first 12 and second 12' concrete pieces. The method comprises the steps of:

- placing the first 14 and second 14' interfacing side surfaces in general abutment contact with each other, with the first 34 and second 34' recesses in alignment with one another;
- positioning the attachment device 10 across the first 12 and second 12' concrete pieces with the elongate base member 20 extending into the first 34 and second 34' recesses and with the first 26 and second 28 lateral members extending through said first 36 and second 36' bore holes of said first 12 and second 12' concrete pieces, respectively; and filling at least said first and second bore holes 36, 36' of the first 12 and second 12' concrete pieces around the first 26 and second 28 lateral members, and an interstice 55 between the first 14 and second 14' interfacing side surfaces with concrete 11.

Conveniently, the step of filling with concrete 11 further includes filling the first 34 and second 34' recesses with concrete 11.

In one embodiment, the steps of positioning and filling further includes:

positioning a top transverse member 40 of the attachment device 10 across the first 12 and second 12' concrete pieces to extend into the first 46 and second 46' top recesses and to connect with at least one said first 26 and second 28 lateral members; and filling the first 34 and second 34' bottom recesses and the first 46 and second 46' top recesses with concrete 11.

In one embodiment, the step of positioning further includes attaching the attachment tab 38 to one of the first 12 and second 12' concrete pieces adjacent a corresponding one said interfacing side surfaces 14, 14'.

In one embodiment, the step of filling further includes filling at least one of the side recesses 48, 48' with concrete 11.

Similarly, in one embodiment, the step of filling further includes filling at least a top edge 50 chamfered recess of at least one of said interfacing side surfaces 14, 14' with concrete 11.

All the area surrounding the interfacing side surfaces 14, 14' are typically enclosed within a forming structure (not shown), with the surface onto which both concrete pieces are laid on partly forming that forming structure, to allow to poured concrete 11 to have a smooth surface finish such that the first 12 and second 12' concrete pieces look like a single concrete piece after the concrete is all set.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinabove described, and herein after claimed.

I claim:

1. A method for attaching two adjacent first and second concrete pieces to one another along corresponding first and second interfacing side surfaces thereof with an attachment device connecting to both the first and second concrete pieces, said first and second concrete pieces having first and second recesses formed therein respectively, said first and second concrete pieces having first and second bore holes respectively extending there through adjacent the corresponding interfacing side surface and connecting with the first and second recesses respectively, said attachment device having an elongate base member and first and second lateral members extending respectively at first and second ends thereof and substantially perpendicularly therefrom, said method comprising the steps of:

placing the first and second interfacing side surfaces in general abutment contact with each other, with the first and second recesses in alignment with one another;

positioning the attachment device across the first and second concrete pieces with the elongate base member extending into the first and second recesses and with the first and second lateral members extending through said first and second bore holes of said first and second concrete pieces, respectively; and filling at least said first and second bore holes of the first and second concrete pieces around the first and second lateral members, and an interstice between the first and second interfacing side surfaces with concrete;

wherein the first and second recesses are first and second bottom recesses and extend into the first and second concrete pieces from corresponding bottom surfaces thereof, the first and second concrete pieces further including first and second top recesses respectively extending therein from corresponding top surfaces thereof, the first and second top recesses being substantially parallel to the corresponding first and second bottom recesses and connecting with a corresponding said first and second bore holes, wherein the step of positioning includes:

positioning a top transverse member of the attachment device across the first and second concrete pieces to extend into the first and second top recesses and to connect with at least one said first and second lateral members; and wherein the step of filling includes:

filling the first and second bottom recesses and the first and second top recesses with concrete so as to ensure a strong interface between the first and second concrete pieces.

2. The method of claim 1, wherein at least one said first and second concrete pieces includes a side recess extending therein from a corresponding said first and second interfacing side surfaces, the side recess communicating with corresponding said first and second bottom recesses and corresponding said first and second top recesses, wherein the step of filling further includes filling the side recess with concrete.

3. The method of claim 2, wherein the side recess is substantially centrally located relative to the corresponding said first and second interfacing side surfaces.

4. The method of claim 1, wherein at least a top outer edge of at least one said interfacing side surfaces is chamfered, wherein the step of filling further includes filling at least a top edge chamfered recess of at least one of said interfacing side surfaces with concrete.

5. The method of claim 1, wherein the elongate base member includes an attachment tab extending substantially perpendicularly therefrom, wherein the step of positioning further includes attaching the attachment tab to one of the first and second concrete pieces adjacent a corresponding one said interfacing side surfaces.

* * * * *